United States Patent [19]

Papadopoulos

[11] 4,286,786

[45] Sep. 1, 1981

[54] SOCCER TRAINING GOAL

[76] Inventor: Andreas T. Papadopoulos, 31 E. Edsall Ave., Palisades Park, N.J. 07650

[21] Appl. No.: 906,935

[22] Filed: May 18, 1978

[51] Int. Cl.[2] ..... A63B 71/02

[52] U.S. Cl. ..... 273/396; 273/348; 273/411; 273/1 R

[58] Field of Search ..... 273/181 F, 182 R, 182 A, 273/179 R, 179 C, 127 R, 127 D, 127 C, 1 B, 1 D, 103, 105 R

[56] References Cited

U.S. PATENT DOCUMENTS

| | | | |
|---|---|---|---|
| 1,540,670 | 6/1925 | Vidmer | 273/181 F |
| 1,629,907 | 5/1927 | Dwyer | 273/182 A |
| 2,838,308 | 6/1958 | Polite | 273/183 X |
| 2,889,149 | 6/1959 | Williams | 273/103 |
| 2,899,208 | 8/1959 | Wallsteiner | 273/103 X |
| 3,001,795 | 9/1961 | Johnson | 273/181 F |
| 3,180,643 | 4/1965 | Kallai | 273/103 X |
| 4,083,561 | 4/1978 | Daffer | 273/103 |

*Primary Examiner*—George J. Marlo
*Attorney, Agent, or Firm*—Constantine A. Michalos; Peter C. Michalos

[57] ABSTRACT

A soccer training goal comprising, a goal frame with a net connected thereto which defines a goal space with a goal opening. An inclined plate is connected to the goal frame at the bottom of the goal space and is inclined downwardly toward the goal opening, whereby a soccer ball kicked into the goal space will initially be retained within the goal space by hitting the net, whereby the net absorbs the impact of the ball and then rolls out of the goal back to the practicing kicker. An adjustment device may be connected between the inclined plate and the goal frame to allow for the variation of the incline on the inclined plate to vary the speed at which the soccer ball leaves the goal space. The inclined plate may further be positioned vertically and provided with markings such as for example, numbers 1 to 10 to act as a soccer ball target to be utilized in accuracy shooting practice. The soccer training goal may be collapsible to allow for its portability and include a field sight, a counting device and a target which can be utilized for accuracy shooting in conjunction with the inclined plate. A triangular block is positioned on the plate to deflect the soccer ball away from the target as it rolls down the plate.

9 Claims, 9 Drawing Figures

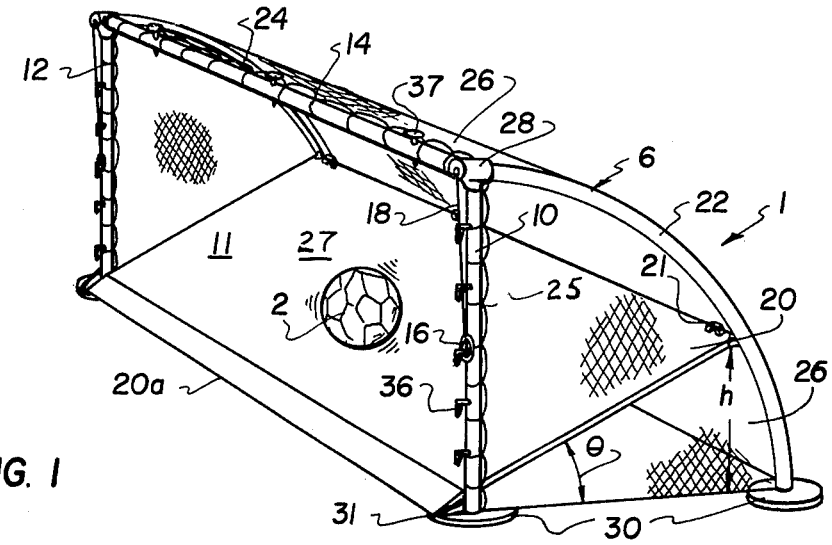
FIG. 1
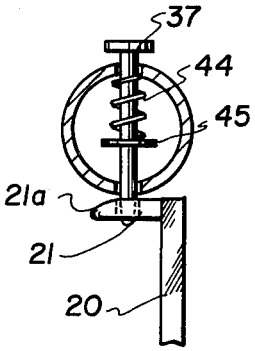
FIG. 2a
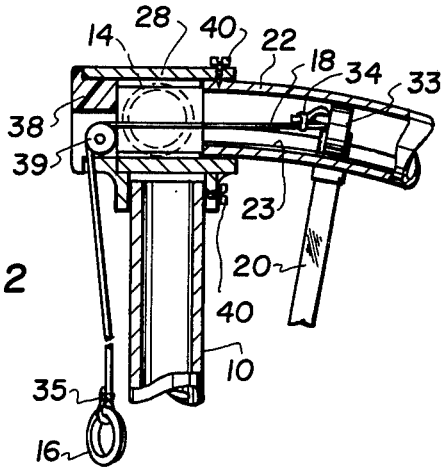
FIG. 2
FIG. 3
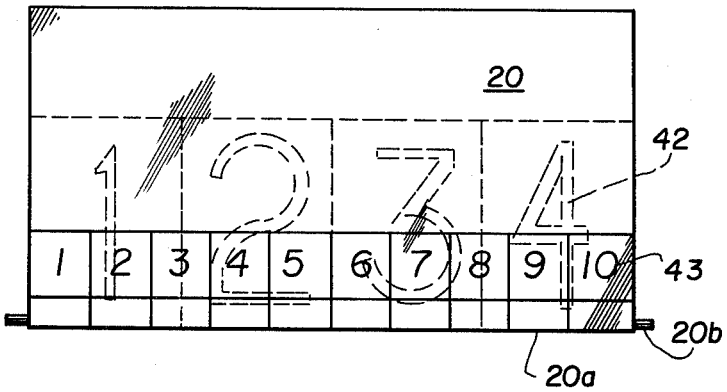

SOCCER TRAINING GOAL

BACKGROUND OF THE INVENTION

1. Field of the Invention

The present invention relates in general to sports training goals and, in particular, to a new and useful soccer training goal which utilizes an adjustable inclined plate to effect the return of a soccer ball once it has been kicked into the soccer goal.

2. Description of the Prior Art

Known soccer goals generally comprise a framework which in its simplest form is made of two vertical uprights connected at their top by a horizontal cross member. These members define a goal opening and a loose fitting net may be connected along the uprights and cross member to define a goal space. Additional frame members may be connected to better define the goal opening, and the entire structure is anchored to a playing field through the use of spikes and the like in a conventional manner. In practicing the game of soccer, players are trained not only to shoot the ball into the goal but also to accurately kick the ball into a selected location of the goal opening. To enhance this practice is has been known to draw a representation of a goal opening on a hard vertical surface, such as a wall, and to practice kicking the ball at selected locations on the wall. Such an arrangement enhances the quick return of the ball so that time is not wasted in fishing the ball out of a goal net which would be the case when practicing with an actual soccer goal.

The use of practice goals are widely known in varied other sports fields and such goals include automatic return means which might be extravagant mechanical devices for redirecting a projectile out of the goal as, for example, a baseball return device, or which may be simple structures as the above mentioned wall arrangement for simply deflecting the projectile away from the goal. Varied and elaborate arrangements are known specifically in the field of golf practice apparatus such as for example U.S. Pat. No. 1,437,591 to Gray, U.S. Pat. No. 1,540,670 to Vidmer, and U.S. Pat. No. 2,899,208 to Wallsteiner. These aforementioned patents all include inclined surfaces for returning a golf ball after it has been driven into a target area of the device. These structures are all concerned with dampening of the golf ball velocity in that the game of golf is specifically concerned in many cases with a fast moving small projectile. Such constructions are not readily adaptable to the game of soccer which utilizes a relatively soft large and slow moving projectile.

SUMMARY OF THE INVENTION

The present invention relates to a soccer goal training device which includes a frame defining a goal opening and having a net connected thereto for defining a goal space. An inclined plate is positionable at the bottom of the goal space, inclined downwardly toward the goal opening. A soccer ball kicked or otherwise directed into the goal space through the goal opening is deflected by the net to initially retain it within the goal space and then rolls out of the goal space through the goal opening due to the incline of the inclined plate. Means may be provided between the inclined plate and the goal frame to adjust the degree of incline of the inclined plate and therefore vary the speed at which the soccer ball leaves the goal. In one embodiment of the invention the inclined plate is provided with a sharp front edge to prevent interference with a soccer ball which is directed into the goal at ground level. The goal frame may comprise two vertical upright members which are connected at their tops by a cross member. The inclined plate may include pivot pins which are rotatively mounted within pivot hinges connected to their respective uprights near ground level. The inclined plate may be supported at a selected angle by latches or the like or may be fixedly connected to the frame. A loose fitting frame net may be disposed around the goal frame to define a goal space and the uprights may be provided with base member or spikes to support the goal frame on a ground surface or for indoor use on a gymnasium floor.

Accordingly an object of the present invention is to provide a soccer training goal comprising, a goal frame, a net connected to said goal frame defining a goal space and a goal opening, and an inclined plate connected to said frame at the bottom of said goal space inclined downwardly toward the goal opening whereby a soccer ball kicked into the goal space, be absorbed by the net and roll on the inclined plate out through the goal opening, thereby the soccer player practices his kicking efficiently.

A further object of the present invention is to provide a soccer training goal which includes an adjustment means connected between the inclined plate and the soccer frame for changing the incline of the inclined plate.

A still further object of the present invention is to provide a soccer training goal which can be used in conjunction with a target disposed within the goal opening and/or a field sight device spaced from the goal opening disposed at ground level, thereby the soccer player practices his accuracy in directing the ball to the goal.

A still further object of the present invention is to provide a soccer training goal which is simple in design, rugged in construction and economical to manufacture.

An additional object of this invention in summary is to provide a soccer training goal for a soccer player to improve his kicking efficiency, accuracy in directing the ball to the goal and increase his stamina, which three elements are the creation of a good soccer player.

These and other objects and features of the invention are pointed out in the following description in terms of the embodiments thereof which are shown in the accompanying drawings. It should be understood, however, that the drawings are for the purpose of illustration only and not for definition of the limitations of the invention.

DESCRIPTION OF THE DRAWINGS

In the drawings:

FIG. 1 is a prospective view of a soccer training goal in accordance with the present invention;

FIG. 2 is a side elevational partly in section partly cut away view of details of the embodiment of FIG. 1.

FIG. 2*a* is a side elevational partly in section cutaway view of a detail of the embodiment of FIG. 1;

FIG. 3 is a front elevational view of the inclined plate in accordance with another embodiment of the invention;

DESCRIPTION OF THE PREFERRED EMBODIMENT

Figure 4:
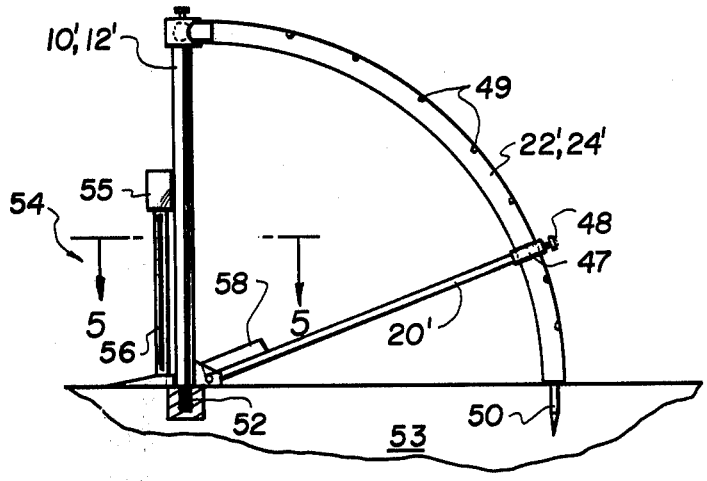
FIG. 4 is a side elevational view of another embodiment of the invention.
Figure 5:
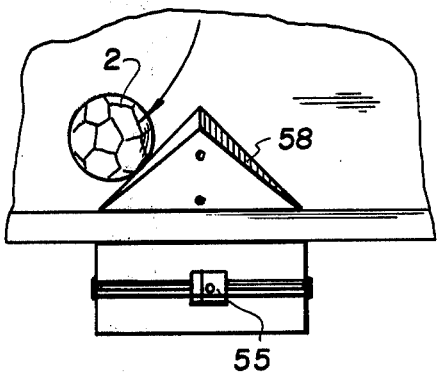
FIG. 5 is a view taken along the line 5—5 of FIG. 4.
Figure 5A:
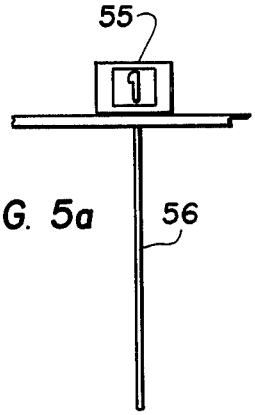
FIG. 5*a* is a side elevational detail of the embodiment shown in FIG. 4.

Referring now to the drawings and particularly the invention embodied in FIG. 1 comprises a soccer training goal generally designated 1 having a frame comprising two uprights 10 and 12 which are supported on a gymnasium floor or field by bases 30. Uprights 10 and 12 are connected by cross member 14 and define a goal opening 11, an inclined plate 20 is positioned near the bottom of goal 1 and is inclined downwardly toward the goal opening 11. Quadrantal braces 22 and 24 are connected to the uprights 10 and 12 respectively and are similarly supported on bases 30. By means of hooks 25 a net 26 is connected between the uprights 10, 12 and the quadrantal braces 22,24. The back net 26 is connected to the cross member 14 with the quadrantal braces 22, 24 by hooks 25. Net 26 defines a goal space 27. The net 26 initially deflects a soccer ball 2 which is directed into the goal space 27 through the goal opening 11. The soccer ball 2 thus deflected, rolls down the incline of inclined plate 20 and out through the goal opening 11. Inclined plate 20 can be provided with a sharp front edge 20*a* which is further inclined toward the ground to prevent the soccer ball 2 from being disadvantageously deflected when it is directed into the goal at ground level. Inclined plate 20 may be pivotally mounted to the upright 10, 12 through pivot hinges 32. For this purpose inclined plate 20 is provided with pivot pins 20*b* (FIG. 3).

The angle $\theta$ between the inclined plate 20 and the ground may be varied through an adjustment means generally designated 6 connected between the inclined plate 20 and the goal frame. Referring now to FIG. 2, one embodiment of the adjustment means comprises a flexible cable 18 which is connected at one end to a ring 16 through a cable clamp 35. Cable 18 is directed over a roller 39 which is rotatively mounted within a cap 38 on the end of braces 22, 24. At its other end, cable 18 is connected to a cylinder 33 through a cable clamp 34. Cylinder 33 is of a size sufficiently small to freely ride within the arcuate member 22 and is connected through an arcuate slot 23 in the quadrantal member 22, to the inclined plate 20. As best seen in FIG. 1, the angle $\theta$ or incline of the inclined plate 20 may be varied by pulling the cable 18 by the ring 16 and positioning the ring 16 at a desired height by engaging it with one of the hooks 36 which are provided on the uprights 10, 12. As hereinafter to be described the height h of the inclined plate 20 is directly related to the angle $\theta$ and can be visually coordinated with the selected hook 36 by providing a scale on the uprights corresponding to the height h. By selecting one of the hooks 36 the desired incline of the inclined plate 20 may be selected which will vary the speed at which the soccer ball 2 leaves the soccer goal 1.

The soccer goal may be made easily disassamblable and thereby portable by providing removeable joints 28 for uniting the cross member 14, the uprights 10, 12 and the quandrantal members 22, 24. Set screws 40 may be provided within the removeable joint 28 to rigidly engage the other members of the frame.

In accordance with the use of the invention, the inclined plate 20 may be brought to its vertical position to simulate a vertical wall for practice purposes. For this purpose cable 18 may be wrapped around the hooks 36 on the uprights 10, 12 and 16 may be engaged over one of the hooks to allow for the vertical positioning of the inclined plate 20. To further insure the rigid vertical positioning of the plate 20, spring loaded support pins 37 may be provided within cross member 14. As best seen in FIG. 2*a*, pins 37 biased downwardly through the action of spring 44 and its engagement with an upset or ring 45 on the pin 37. Inclined plate 20 may be provided at its top peripheral edge with loops or rings 21 which engage with pins 37 when plate 20 is in its vertical position. Rings or loops 21 may further be provided with cam surfaces 21*a* so that pins 37 are automatically deflected upwardly against the bias of springs 44 to permit the engagement of pins 37 into rings or loops 21. Referring to FIG. 3, inclined plate 20 may be provided with large markings 42 for indicating desired target areas to be aimed in soccer shooting practice. For more advanced practice smaller markings 43 may be provided.

Figure 6:
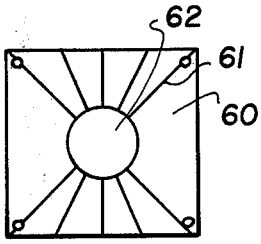
FIG. 6 is a top plan view of a field sight used in accordance with the invention.

Referring now to FIG. 4, another embodiment of the present invention is disclosed having uprights 10′, 12′ and quadrantal braces 22′, 24′. Quadrantal braces 22′, 24′, are provided with holes 49 to accommodate spring loaded pins which are connected to sleeves 47 that are in turn connected to opposite top corners of inclined plate 20′. To vary the incline of the inclined plate 20′, pins 48 are withdrawn from holes 49 and the inclined plate 20′ is positioned at a desired incline corresponding to one other of the holes 49 and pins 48 are reinserted therein. For use on a gymnasium, uprights and quandrantal braces may be provided with threaded support members 52 for threading into a gymnasium floor 53 or alternatively for use on a field, spikes 50 may be provided. A target generally designated 54 may be used in conjunction with the goal by positioning it adjacent the goal opening 11. Target 54 is provided with a counter 55 for indicating the number of shots passing through the target 54. The number of shots are counted by the activation of a hanging sensor rod 56 which is pushed out of the way by an incoming soccer ball. In order to prevent interference between a soccer ball rolling out of the goal opening and the target, deflecting block 58 is provided on the inclined plate 20′ having angled faces for deflecting soccer ball 2 away from the target 54. Referring now to FIG. 6, a field sight 60 may be provided at a spaced location in front of the goal to aid in the aiming of the soccer ball. A soccer ball may be placed for example on a ballmark 62 and radial lines or marks 61 may be provided on the field sight 60 to align the angling of the desired shot.

Figure 7:
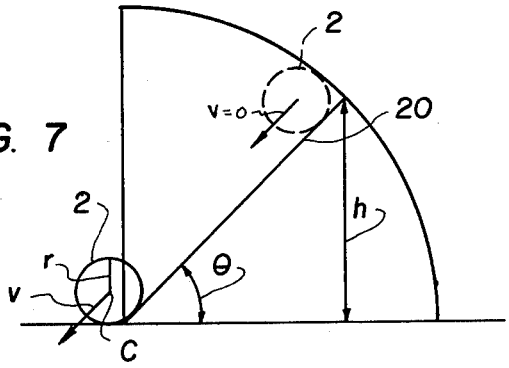
FIG. 7 is a vector diagram of the motion of a soccer ball used in accordance with the invention.

In as much as the speed at which the soccer ball leaves the goal is directly proportional to the angle of incline of the inclined plate, a coach or the like may determine the speed at which a soccer ball will be returned to a player by adjusting that incline. Referring to FIG. 7 it will be appreciated that the height h, which is the height of the top edge of the inclined plate 20, is directly proportional to the speed of a soccer ball 2 leaving the goal. To illustrate this the following calculations are presented:

Provided there is no slippage when the soccer ball rolls down the incline, the potential energy when the ball is at the top of the incline, is converted into Kinetic energy of translation and Kinetic energy of rotation at the bottom of the incline. At the top of the incline plate the speed of the ball is assumed to be zero. The potential energy is expressed as:

$$E_p = mgh \quad (1)$$

Where m is the mass of the ball, g is the gravitational acceleration and h is the height of the ball in the starting position.

h can be assumed to be at about the top of the incline

For kinetic energy we have:

$$E_k = \tfrac{1}{2}mv^2 + Iw^2 \quad (2)$$

Where v is the linear speed at the bottom of the incline or at the goal opening, I is the moment of inertia about an axis through C and w is angular velocity. ($\frac{1}{2}$ $Iw^2$ is the energy due to the rolling action of the ball, while $\frac{1}{2}$ $mv^2$ is energy due to the linear motion. Thus:

$$\tfrac{1}{2}mv^2 + \tfrac{1}{2}Iw^2 = mgh \quad (3)$$

For a sperical shell with inside radius $r_1$ and outside $r_2$:

$$I = \left(\frac{2}{5}m\right) \cdot \left(\frac{r_2^5}{r_2^3} - \frac{r_1^5}{r_1^3}\right) \quad (4)$$

Since $r_1$ is almost equal to $r_2$ in a soccer ball, equation 4 can be in terms of r (radius of the ball). From calculus: as $r_2$ approaches $r_1$ the term:

$$\frac{r_2^5 - r_1^5}{r_2^3 - r_1^3}$$

approaches 5/3 $r^2$; thus $I = \frac{2}{3}$ $mr^2$

From equation (3):

$$mgh = \tfrac{1}{2}mv^2 + \tfrac{1}{2}(\tfrac{2}{3}mr^2)\, w^2 \quad (5)$$

Since $w = v/r$ $$mgh = \tfrac{1}{2}mv^2 + \tfrac{1}{3}mr^2v^2/r_2$$

solving for $v^2$:

$$v^2 = 6/5gh \quad (6)$$

Since 6/5 and g are constant, the final speed of the soccer ball coming out of the goal is a function of h the height set on the inclined plate (specifically proportional to the square root of h). The speed is independent of the size and the weight of the soccer ball.

While the present invention has been described in terms of a preferred embodiment, it will be obvious to those skilled in the art that various modifications can be made without departing from the scope of the invention.

What is claimed is:

1. A soccer training goal comprising a goal frame, a net connected to said goal frame defining a goal space with a goal opening, an inclined plate connected to said frame at the bottom of said goal space inclined downwardly toward the goal opening, whereby a soccer ball directed through said goal space is deflected by said net so as to initially retain the soccer ball within said goal space and whereby the soccer ball rolls down said inclined plate and out of said goal space back to the practicing kicker, adjustment means connected between said inclined plate and said goal frame for adjusting the degree of incline of said inclined plate and varying the speed at which the soccer ball leaves said goal space, said goal frame comprising a pair of uprights, a cross member connected between said uprights defining said goal opening, a pair of quadrantal braces connected to adjacent tops of said uprights adjacent said cross member extending rearwardly and downwardly of said goal opening, said adjustment means comprising a cylinder slideable mounted within each of said quadrantal braces connected to said inclined plate, and a cable connected to each cylinder extending through each of said quadrantal braces and out thereof adjacent said goal opening.

2. A soccer training goal according to claim 1 wherein said cables further include a ring at the end of each cable and each upright further includes a plurality of hooks engageable with said rings for adjusting the incline of said inclined plate.

3. A soccer training goal according to claim 1 wherein said cross member further includes at least one spring loaded support pin and said inclined plate includes at least one loop engageable with said support pin when said inclined plate is vertically positioned within said goal opening.

4. A soccer training goal according to claim 1 wherein said inclined plate is pivotally mounted to said goal frame.

5. A soccer training goal according to claim 1 wherein said inclined plate is positionable in the vertical position and includes markings to act as targets for aiming a soccer ball.

6. A soccer training goal according to claim 1 further including a target having a counter for indicating the number of soccer balls directed through said target, and including a triangular raised deflecting block positioned on said inclined plate behind said target for deflecting said soccer ball away from said target as it rolls down said inclined plate and out of said goal opening.

7. A soccer training goal according to claim 1 wherein said goal frame and inclined plate are disassemblable to effect a portability of the apparatus.

8. A soccer training goal according to claim 1 further including a field sight having radially extending markings positionable in front of said goal opening to act as a sight for directing the soccer ball into said goal opening.

9. A soccer training goal comprising a goal frame, a net connected to said goal frame defining a goal space with a goal opening, an inclined plate connected to said frame at the bottom of said goal space inclined downwardly toward the goal opening, whereby a soccer ball directed through said goal space is deflected by said net so as to initially retain the soccer ball within said goal space and whereby the soccer ball rolls down said inclined plate and out of said goal space back to the practicing kicker, adjustment means connected between said inclined plate and said goal frame for adjusting the degree of incline of said inclined plate and varying the speed at which the soccer ball leaves said goal space, said goal frame comprising a pair of uprights, a cross-member connected between said uprights, and a pair of quadrantal braces extending rearwardly and downwardly of said uprights, said uprights and cross member defining said goal opening, said adjustment means comprising a sleeve slideably engaged about each quadrantal brace connected to said inclined plate, a spring loaded locking pin mounted on each sleeve, each of said quadrantal braces including a plurality of spaced holes engageable with said locking pins for adjusting the degree of incline of said inclined plate to determine the speed at which the soccer ball leaves said goal opening.

* * * * *